US008012320B2

(12) United States Patent
Maumus

(10) Patent No.: US 8,012,320 B2
(45) Date of Patent: Sep. 6, 2011

(54) DEVICE FOR SUPPORTING ELECTRODES IN AN ELECTROLYSIS INSTALLATION

(75) Inventor: Jean-Pierre Maumus, Saint Medard en Jalles (FR)

(73) Assignee: Snecma Propulsion Solide, Le Haillan (FR)

( * ) Notice: Subject to any disclaimer, the term of this patent is extended or adjusted under 35 U.S.C. 154(b) by 303 days.

(21) Appl. No.: 12/335,653

(22) Filed: Dec. 16, 2008

(65) Prior Publication Data

US 2009/0159437 A1 Jun. 25, 2009

(30) Foreign Application Priority Data

Dec. 20, 2007 (FR) ..... 07 60070

(51) Int. Cl.
*C25B 9/02* (2006.01)
*C25B 9/04* (2006.01)
*C25B 9/06* (2006.01)

(52) U.S. Cl. ..... 204/288.2; 204/286.1; 204/297.01; 204/278.5; 204/288

(58) Field of Classification Search ..... 204/286.1, 204/297.01, 288, 278.5, 288.2
See application file for complete search history.

(56) References Cited

U.S. PATENT DOCUMENTS

| | | | | |
|---|---|---|---|---|
| 3,767,556 | A * | 10/1973 | Muzhavlev et al. | 204/247.4 |
| 4,264,426 | A * | 4/1981 | Kuusinen et al. | 204/242 |
| 4,950,370 | A * | 8/1990 | Tarancon | 205/619 |
| 5,989,504 | A * | 11/1999 | Wilson et al. | 423/23 |
| 6,068,925 | A * | 5/2000 | Wilson et al. | 428/408 |
| 6,537,372 | B1 | 3/2003 | Schupp | |
| 2009/0205952 | A1 * | 8/2009 | Maumus et al. | 204/252 |

FOREIGN PATENT DOCUMENTS

| | | |
|---|---|---|
| EP | 0534081 | 3/1993 |
| GB | 2135335 | 8/1984 |

* cited by examiner

*Primary Examiner* — Bruce Bell
(74) *Attorney, Agent, or Firm* — Weingarten, Schurgin, Gagnebin & Lebovici LLP

(57) ABSTRACT

The invention relates to a device for supporting electrodes in an electrolysis installation, said support comprising a busbar having electrodes fastened thereto, said electrodes being disposed on either side of the busbar and extending vertically below said busbar, the busbar and said electrodes being designed to be immersed at least in part in an electrolyte that gives off one or more gaseous species of a corrosive nature. The device further comprises a protective element of carbon/carbon material placed under the busbar, the protective element being of length and width that are not less than the length and the width of the busbar.

9 Claims, 5 Drawing Sheets

DEVICE FOR SUPPORTING ELECTRODES IN AN ELECTROLYSIS INSTALLATION

BACKGROUND OF THE INVENTION

The present invention relates to the field of electrolysis cells or installations. FIG. 1 is a diagram of an electrolysis installation 100 used for producing fluorine. The installation 100 comprises a tank 101 containing an electrolyte 102, e.g. a solution of hydrofluoric acid (HF), and having two series of electrodes immersed therein, namely a first series of cathodes 103 and a second series of anodes 104. The anodes 104 are fastened and electrically connected to each side of a busbar 105. The busbar 105 serves both as a support and as a distributor of electrolysis current for the electrodes 104. In well-known manner, the busbar 105 is connected to the positive terminal of a direct current (DC) generator (not shown in the figures) by conductors 106 placed in threaded rods 107, while the cathodes 103 are connected to the negative terminal of the generator. The anodes 104 are distributed longitudinally on each side of the busbar 105 and they project beyond the bottom face 105*a* of the busbar.

FIG. 2 shows the electrolysis installation 100 while it is in operation, i.e. when the electrodes 103, 104 are immersed in the electrolyte and are powered by the DC generator. When the electrolyte is made up of hydrofluoric acid, for example, electrolysis leads to bubbles of gaseous fluorine 108 being given off at the anodes 104 and bubbles of hydrogen 109 being given off at the cathodes 103. The bubbles of these two gaseous species rise to the surface of the electrolyte and they are collected by independent ducts (not shown in the figure) in the top portion of the electrolysis installation 100.

The bubbles of gaseous fluorine 108 give rise to corrosion and erosion of the elements of the installation with which they come into contact during electrolysis. Given their chemical nature, the bubbles 108 are very corrosive, and as they rise towards the surface of the electrolytes they give rise to an erosion phenomenon on the anodes 104 and more particularly on the busbar 105 whose bottom face 105*a* receives practically all of the fluorine bubbles given off by the inside walls of the anodes 104, these bubbles then flowing along the bottom face 105*a* until they find a path to the surface of the electrolyte 102.

Consequently, in any electrolysis installation that produces one or more corrosive gaseous species, the corrosion and the erosion resulting from the gases being given off make it necessary to replace the busbar and the anodes frequently.

To mitigate this problem, one solution consists in making the busbar and possibly also the anodes out of graphite, which is a material that is known to present good resistance to corrosion. Nevertheless, even though graphite does present improved resistance to the combined corrosion and erosion phenomenon compared with the metal materials commonly used, that is not sufficient to prevent the anodes and above all the busbar deteriorating during electrolysis. Thus, even when made of graphite, busbars need to be replaced frequently. On each replacement, the electrolysis installation, and consequently the production of the gaseous species, must be stopped. Busbar wear by the corrosion-erosion phenomenon thus leads to periods in which the electrolysis installation is not in operation and it is desirable for these periods to be shortened in order to improve the efficiency of the installation.

OBJECT AND SUMMARY OF THE INVENTION

An object of the present invention is to propose a design solution that enables a busbar of an electrolysis installation to be protected against the corrosion-erosion phenomenon caused by gaseous species being given off during electrolysis, thereby increasing its lifetime.

To this end, the present invention provides a device for supporting electrodes in an electrolysis installation, said support comprising a busbar having electrodes fastened thereto, said electrodes being disposed on either side of the busbar and extending vertically below said busbar, the busbar and said electrodes being designed to be immersed at least in part in an electrolyte that gives off one or more gaseous species of a corrosive nature, wherein the device further comprises a protective element placed under the busbar, and having a length and a width that are not less than the length and the width of the busbar, and wherein said protective element is made of carbon/carbon material.

Thus, by placing a carbon/carbon element under the busbar, the busbar is protected against the bubbles of corrosive species given off by the electrodes during electrolysis. Since the protective element covers at least the bottom face of the busbar, it prevents the bubbles of corrosive species that are rising to the surface of the electrolyte from encountering the busbar, thereby protecting it from wear due to the above-described corrosion-erosion phenomenon. The lifetime of the busbar is thus considerably lengthened.

Furthermore, the protective element is made of carbon/carbon which is a material that is particularly good at withstanding the corrosion-erosion phenomenon. Thus, in the presence of the corrosive gas that has been given off, the assembly formed by the busbar and the protective element withstands the corrosion-erosion phenomenon much longer than is possible with a busbar on its own, even if the busbar is made of graphite. Consequently, with the electrode support device of the invention, the frequency with which electrolysis installations are shut down for replacing worn busbars is significantly reduced compared with the usual frequency.

The protective element may be held in grooves formed in the electrodes or it may be fastened to the busbar by fastener members.

In an aspect of the invention, the face of the protective element opposite from its face facing the busbar presents a profile that is concave. This profile serves to channel the bubbles of corrosive gaseous species given off by the electrodes and to guide them towards the longitudinal ends of the protective element. The concave face may also have a slight slope inclined towards one of the longitudinal ends of the protective element in order to guide the bubbles to that end.

In another aspect of the invention, the protective element includes fins on its two longitudinally-extending sides, the fins extending above the face of said element that faces the busbar. The fins present widths that correspond substantially to the gaps left between pairs of adjacent electrodes and they are spaced apart from one another by distances that correspond substantially to the widths of the electrodes. With such fins, the protective element also protects the flanks of the busbar where they are exposed between two electrodes.

The protective element may be made as a single piece (one-piece structure) or as a plurality of adjacent sectors that are assembled together via overlapping portions.

The present invention also provides an electrolysis installation including at least one electrode support device as described above.

BRIEF DESCRIPTION OF THE DRAWINGS

Other characteristics and advantages of the invention appear from the following description of particular embodiments of the invention given as non-limiting examples and with reference to the accompanying drawings, in which.

DETAILED DESCRIPTION OF EMBODIMENTS

A particular but non-exclusive field of application of the invention is that of electrolysis installations for producing gaseous species of a corrosive nature such as fluorine or chlorine, for example. The present invention seeks to protect the busbars used as electrode carriers in such installations against the above-described corrosion-erosion phenomenon when a corrosive gaseous species is given off by the electrodes. For this purpose, the present invention proposes using a protective element made of carbon/carbon that serves to isolate the busbar from the corrosive gas given off during electrolysis. Embodiments of electrode support devices making use of such a protective element are described below.

Each support element described below is made of carbon/carbon (C/C) composite material which, in known manner, is a material made up of carbon fiber reinforcement densified by a carbon matrix. C/C composite material presents very good resistance to corrosion and also to erosion.

The manufacture of parts made of C/C composite material is well known. It generally comprises making a carbon fiber preform of shape close to that of the part that is to be fabricated, and then densifying the preform with the matrix.

The fiber preform constitutes the reinforcement of the part and its essential function concerns mechanical properties. The preform is obtained from fiber textures: yarns, tows, braids, cloth, felts, . . . . Shaping is performed by winding, weaving, stacking, and possibly also needling two-dimensional plies of cloth or sheets of tow, . . . .

The fiber reinforcement can be densified by a liquid technique (being impregnated with a resin that is a precursor of the carbon matrix and then transforming the resin by cross-linking and pyrolysis, which process can be repeated), or by a gaseous technique (chemical vapor infiltration of the carbon matrix).

Figure 1:
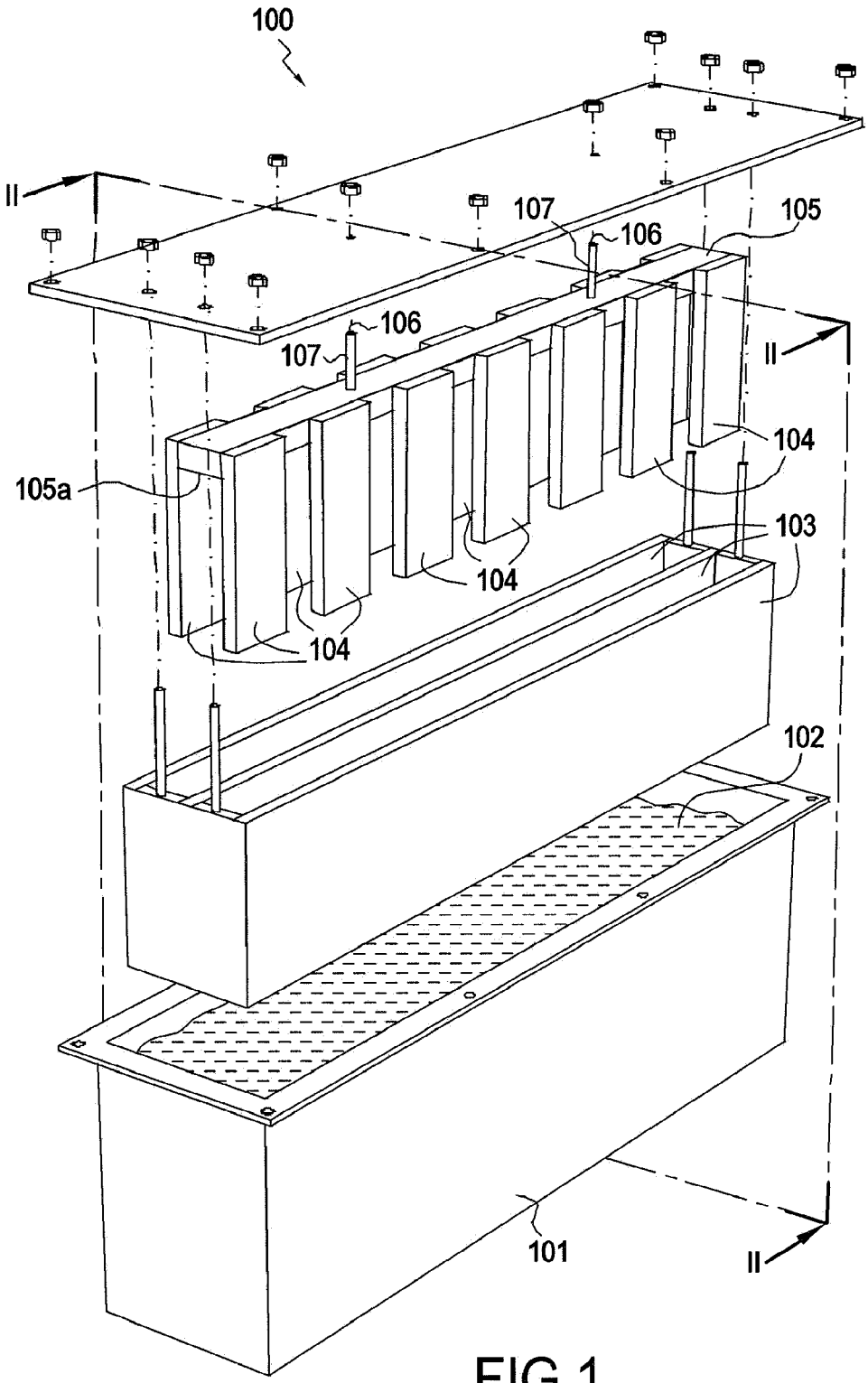
FIG.1 (PRIOR ART)
FIG. 1 is an exploded diagrammatic view of an electrolysis installation.
Figure 2:
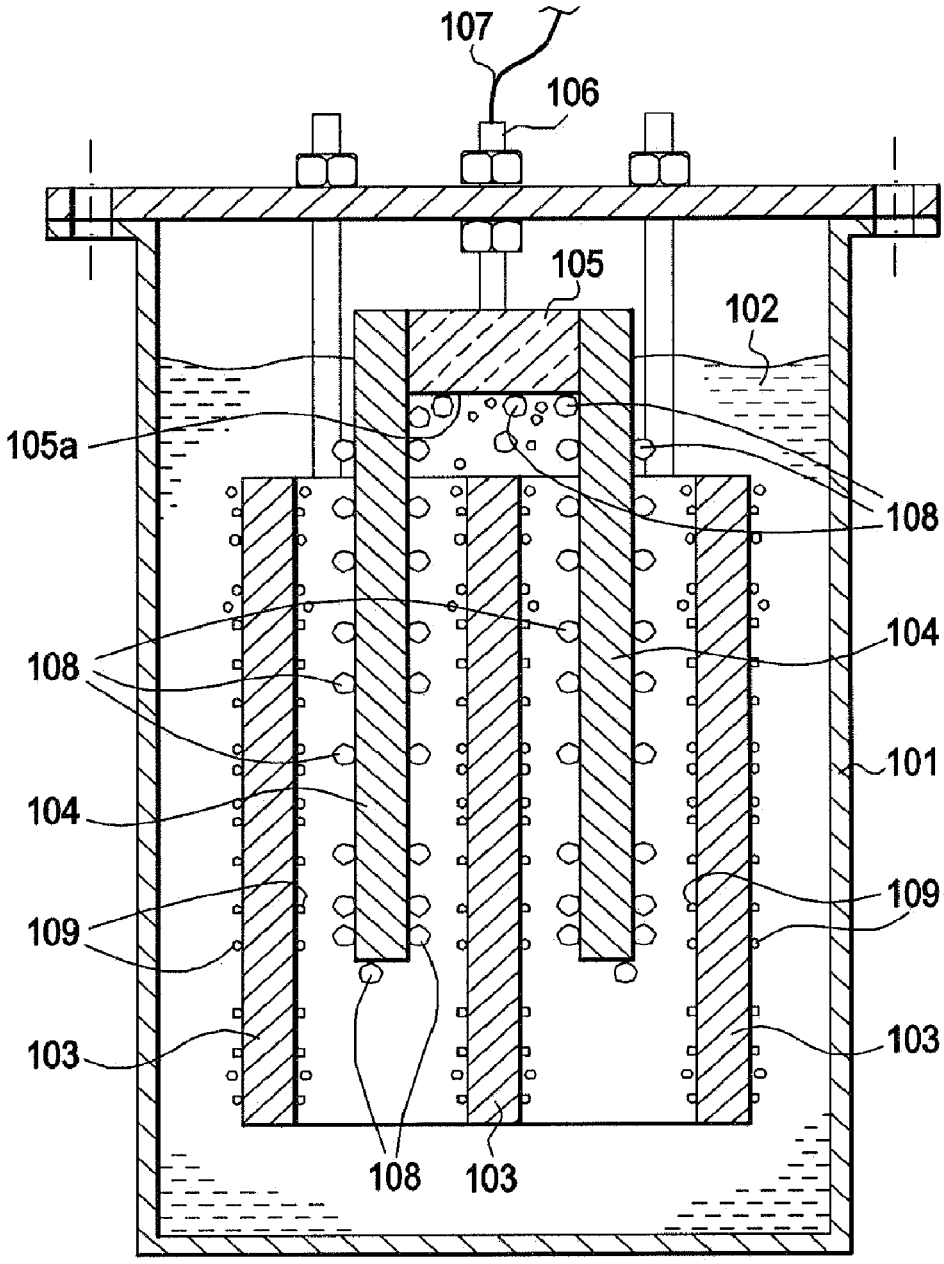
FIG.2 (PRIOR ART)
FIG. 2 is a section view of the FIG. 1 electrolysis installation when assembled and in operation.
Figure 3:
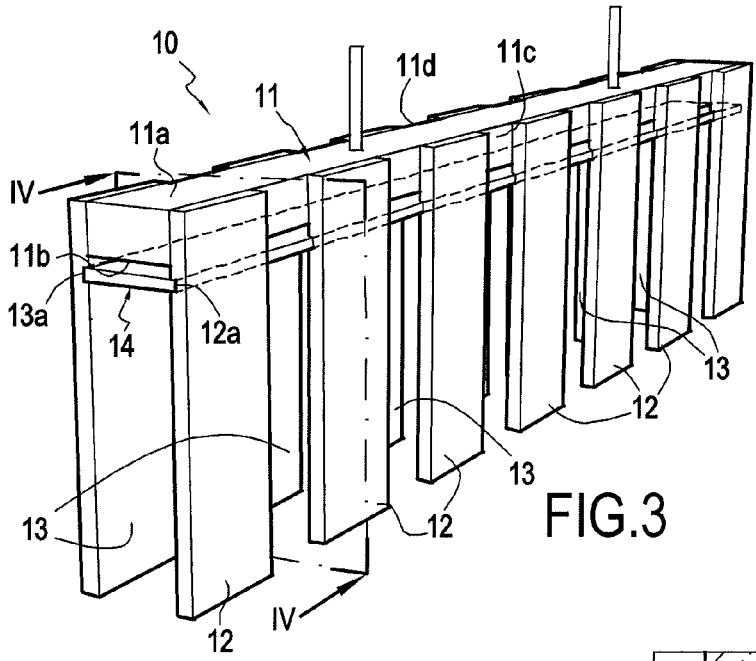
FIG. 3 is a diagrammatic perspective view of an electrode support device in an embodiment of the invention.

FIG. 3 shows a first embodiment of a support device 10 in accordance with the invention. The support device 10 comprises a busbar 11 in the form of a rectangular block presenting a top face 11*a*, a bottom face 11*b*, and two side faces 11*c* and 11*d*. In the example described, the busbar 11 is made of copper. Nevertheless, the busbar could be made of some other conductive material, such as graphite. A first series of electrodes 12 and a second series of electrodes 13 are fastened respectively on the side faces 11*c* and 11*d* of the busbar 11. The electrodes 12 and 13 are distributed uniformly along the busbar 11 with gaps between adjacent pairs of electrodes. The electrodes 12 and 13 are made of graphite. Each electrode is constituted by a rectangular plate that extends below the bottom face 11*d* of the busbar 11. The electrodes 12 and 13 are electrically connected to the busbar 11 that serves to feed the electrodes with current for electrolysis. For this purpose, the electrodes may be fastened to the busbar by connection means that ensure electrical conduction. In particular, the electrodes may be fastened by the busbar by brazing or by bonding with a conductive adhesive. The busbar 11 consequently performs both the function of an electrode carrier and the function of delivering electrolysis current to the electrodes.

In accordance with the present invention, the support device includes a protective element 14 constituted by a plate made of C/C composite material. The protective element 14 is placed under the busbar 11 in the vicinity of its bottom face 11*b*. More precisely, the protective element 14 is put into place by being slid in grooves 12A and 13A formed respectively in the electrodes 12 and 13. These grooves serve to hold the protective element in place at a determined distance under the busbar. A certain amount of clearance is preferably conserved between the protective element and the busbar in order to compensate for differential expansion between the material of the busbar (copper or other metal) and the material of the protective element (C/C composite material).

Figure 4:
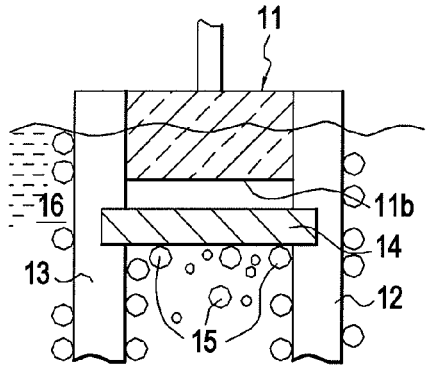
FIG. 4 is a section view of the FIG. 3 electrode support device when bubbles of corrosive species are being given off by the electrodes.

The protective element 14 presents length and width that are slightly greater than those of the busbar 11. Consequently, the protective element forms a screen facing the entire bottom face 11*b* of the busbar and protecting it against the corrosion-erosion phenomenon when a corrosive gaseous species is given off by the electrodes. As shown in FIG. 4, during electrolysis, i.e. while the electrodes 12 and 13 are immersed in an electrolyte 16 and are being fed with electrolysis current, bubbles 15 of the corrosive species are given off on the lower portions of the electrodes and they are stopped from rising by the protective element 14 that forms a screen in front of the bottom face 11*b* of the busbar. The bubbles 15 are then evacuated to the surface of the electrolyte by going past the edges of the protective element 14. Thus, with the protective element 14, the bubbles of corrosive species that have been given off no longer strike the bottom face of the busbar, thereby considerably reducing the influence of the corrosion-erosion phenomenon thereon.

Figure 5:
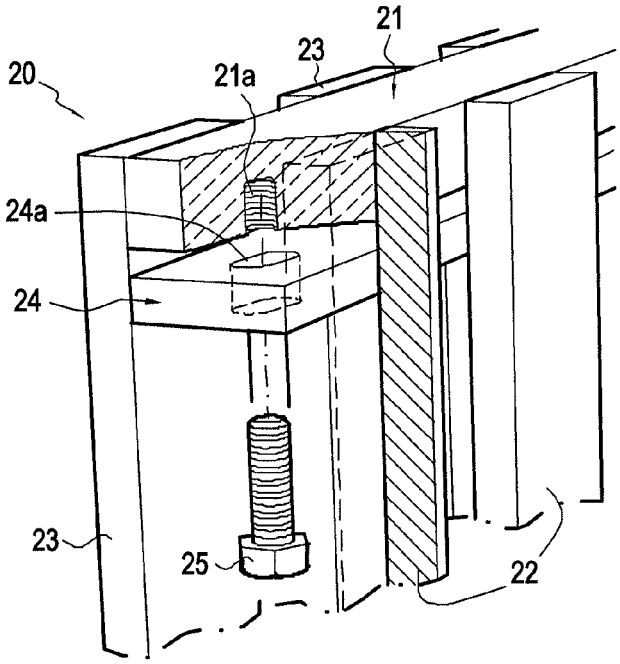
FIG. 5 is a fragmentary diagrammatic view in perspective of an electrode support device in another embodiment of the invention.

FIG. 5 shows a variant embodiment of a support device 20 of the invention that differs from that described above in that it includes a protective element 24 that is held in position under a busbar 21 and between electrodes 22 and 23 by bolts 25. The protective element includes oblong holes 24A for passing the bolts 25 and for adjusting the position of the element, the bolts being received in tapped holes 21A formed in the busbar 21.

Figure 6:
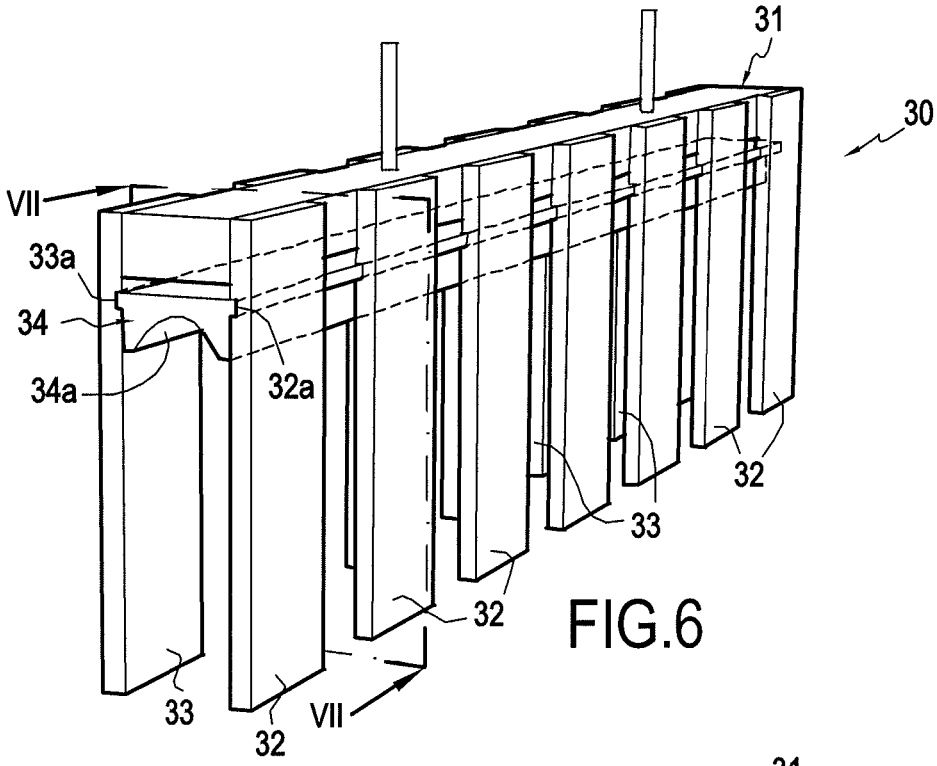
FIG. 6 is a diagrammatic view in perspective of an electrode support device in another embodiment of the invention.
Figure 7:
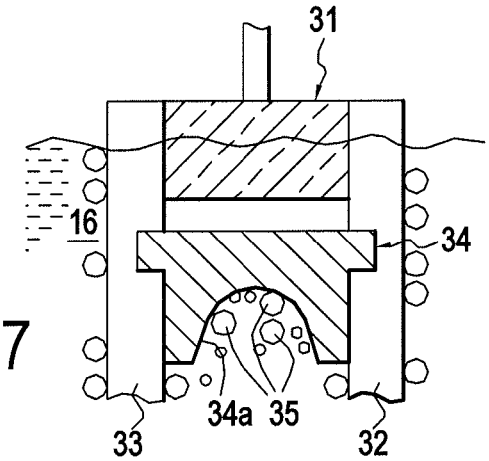
FIG. 7 is a section view of the FIG. 6 electrode support device when bubbles of corrosive species are being given off by the electrodes.

The face of the protective element that is to receive the bubbles of the corrosive gaseous species given off by the electrodes may present a plane surface as shown in FIGS. 3 to 5. Nevertheless, as shown in FIG. 6, the protective element may also have a bottom face that presents a concave surface. More precisely, FIG. 6 shows a support device 30 including, like the device of FIG. 3, a protective element 34 that is held under the busbar 31 by grooves 32A and 33A formed respectively in electrodes 32 and 33, but having a bottom face 34A that presents a concave profile. As shown in FIG. 7, the concave shape of the bottom face 34A of the protective element serves to channel the bubbles 35 of the corrosive gaseous species given off by the electrodes 32 and to guide them towards the longitudinal ends of the protective element 34. This reduces the quantity of bubbles 35 that escape through the gaps left between the electrodes 32 or 33, thereby better protecting the flanks of the busbar where they are exposed in the gaps. The concave surface of the bottom face of the protective element may also slope a little so as to guide the bubbles better towards one longitudinal end of the protective element.

Figure 8:
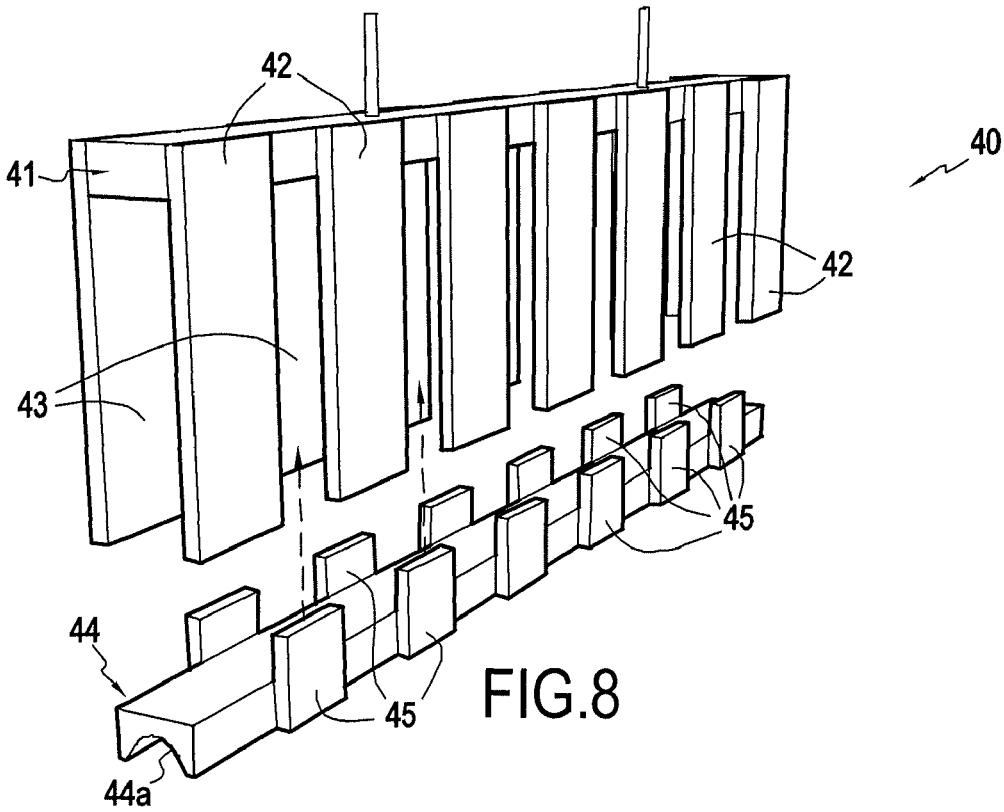
FIGS. 8 and 9 are diagrammatic perspective views of an electrode support device in another embodiment of the invention.
Figure 9:
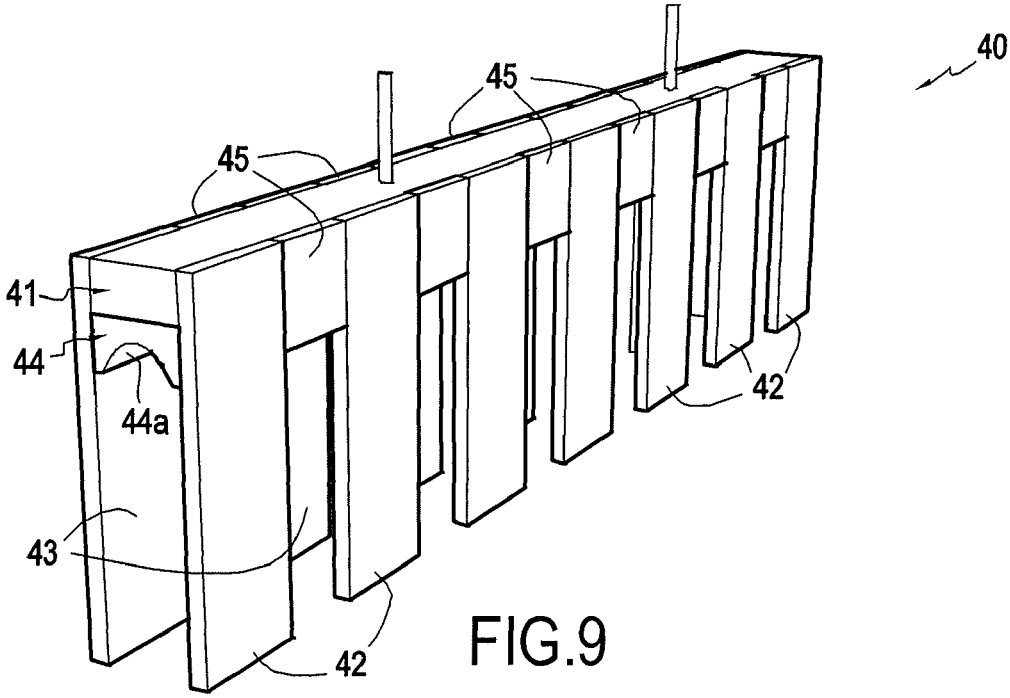

FIGS. 8 and 9 show another embodiment of a support device of the invention, respectively before and after assembly of the protective element. The support device 40 shown in these figures differs from those described above in that the protective element 44 is also provided with lateral protective fins 45. The spacing and the width of the fins 45 are selected to fill in the empty gaps left between the electrodes 42 and between the electrodes 43. The protective element 44 may be fastened to the busbar 41 by adhesive or by fastener members of the screw-fastener type. Once the support device 40 has been assembled under the busbar 41, the fins 45 cover the flanks of the busbar where they are exposed between the electrodes, thereby protecting them against the bubbles of corrosive species escaping between two electrodes. The protective element 44 shown in FIGS. 8 and 9 has a bottom face 44A with a concave profile serving to channel the bubbles given off by the electrodes towards the longitudinal ends of the protective element. Nevertheless, the protective element 44 may also have a bottom face that is plane.

Figure 10:
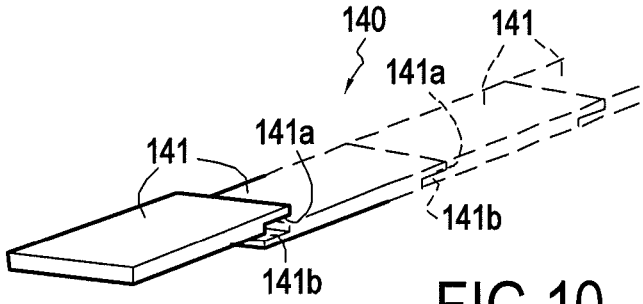
FIG. 10 shows a variant embodiment of the FIG. 3 electrode support device.

The protective elements of the invention described above can be made out of a single piece of carbon/carbon composite material. Nevertheless, particularly when making a protective element of large size, the element may be built up as an assembly of a plurality of sectors, each made individually out of carbon/carbon composite material. FIG. 10 shows an embodiment of a protective element 140 similar to the protective element 14 of FIG. 3, but differing therefrom in that it is made up as an assembly as a plurality of sectors 141. The sectors are preferably made with one or two overlap portions 141*a*, 141*b* (one overlap portion for each end sector, two for each intermediate sector), enabling the sectors to be assembled together, e.g. by brazing.

What is claimed is:

1. A device for supporting electrodes in an electrolysis installation, said support comprising a busbar having electrodes fastened thereto, said electrodes being disposed on either side of the busbar and extending vertically below said busbar, the busbar and said electrodes being designed to be immersed at least in part in an electrolyte that gives off one or more gaseous species of a corrosive nature, wherein the device further comprises a protective element placed under an underside of the busbar with said protective element blocking said gaseous species from the underside of the busbar, said protective element being of a length and a width that are not less than the length and the width of the busbar, and wherein said protective element is made of carbon/carbon material.

2. A device according to claim 1, wherein the protective element is held in grooves formed in the electrodes.

3. A device according to claim 1, wherein the protective element is fastened to the busbar by fastener members.

4. A device according to claim 1, wherein the face of the protective element opposite from its face facing the busbar presents a profile that is concave.

5. A device according to claim 4, wherein said face of the protective element opposite from its face facing the busbar also presents a slope that is inclined towards one of the longitudinal ends of the protective element.

6. A device according to claim 1, wherein the protective element includes fins on both of its longitudinal sides, the fins extending above the face of said element that faces the busbar and presenting widths that correspond substantially to the gaps present between two adjacent electrodes.

7. A device according to claim 1, wherein the protective element presents a one-piece structure.

8. A device according to claim 1, wherein the protective element comprises a plurality of adjacent sectors assembled together via overlap portions.

9. An electrolysis installation including at least one electrode support device according to claim 1.

* * * * *